US005800330A

United States Patent [19]

Modéer

[11] Patent Number: 5,800,330

[45] Date of Patent: Sep. 1, 1998

[54] METHOD AND EQUIPMENT FOR MONITORING A CENTRIFUGAL SEPARATOR

[75] Inventor: Bo Modéer, Tumba, Sweden

[73] Assignee: Alfa Laval AB, Lund, Sweden

[21] Appl. No.: 776,200

[22] PCT Filed: Jul. 20, 1995

[86] PCT No.: PCT/SE95/00877

§ 371 Date: Apr. 18, 1997

§ 102(e) Date: Apr. 18, 1997

[87] PCT Pub. No.: WO96/03214

PCT Pub. Date: Feb. 8, 1996

[30] Foreign Application Priority Data

Jul. 22, 1994 [SE] Sweden ..... 9402563

[51] Int. Cl.[6] ..... B04B 1/14; B04B 11/04

[52] U.S. Cl. ..... 494/2; 494/5; 494/10; 494/11; 494/37

[58] Field of Search ..... 494/1–5, 10, 11, 494/23, 27, 30, 37, 56, 68, 70, 85

[56] References Cited

U.S. PATENT DOCUMENTS

| | | | |
|---|---|---|---|
| 3,160,589 | 12/1964 | Stone . | |
| 3,167,509 | 1/1965 | Steinacker | 494/3 |
| 3,593,915 | 7/1971 | Steinacker | 494/3 |
| 3,976,242 | 8/1976 | Hemfort | 494/3 |
| 4,305,817 | 12/1981 | Kohlstette | 494/3 X |
| 4,411,645 | 10/1983 | Tenthoff | 494/3 |
| 4,820,256 | 4/1989 | Nordstrom | 494/5 X |
| 4,840,612 | 6/1989 | Pallmar | 494/2 |

FOREIGN PATENT DOCUMENTS

| | | |
|---|---|---|
| 3841634 | 8/1989 | Germany . |
| 345603 | 6/1972 | Sweden . |
| 375021 | 4/1975 | Sweden . |
| 413464 | 6/1980 | Sweden . |
| 422416 | 3/1982 | Sweden . |
| 8804601 | 6/1989 | Sweden . |

*Primary Examiner*—Charles E. Cooley
*Attorney, Agent, or Firm*—Fish & Richardson P.C.

[57] ABSTRACT

Method and equipment for monitoring a centrifugal separator, with a separation chamber (6), a radially inner outlet (18, 19, 20) connected to the separation chamber (6), which is connected to an outlet conduit (21), a flow sensor (28) in the outlet conduit (21) being arranged to indicate a flow in the outlet conduit, an intermittently operable radially outer outlet (7) connected to the separation chamber (6), the flow of the separated component in the outlet conduit (21) ceasing temporarily until the separation chamber (6) has been refilled. In order to monitor the centrifugal separator in a reliable and easy manner the time for the refilling of the separation chamber (6) is measured and is compared with a shortest allowable time for the refilling of the separation chamber (6) stored and a signal is given if the measured time is shorter than the shortest allowable time stored in the memory.

10 Claims, 2 Drawing Sheets

METHOD AND EQUIPMENT FOR MONITORING A CENTRIFUGAL SEPARATOR

FIELD OF THE INVENTION

The present invention concerns a method and equipment for monitoring a centrifugal separator, which has a rotor, which forms an inlet chamber, a separation chamber connected to the inlet chamber, a radially inner outlet, which is connected to the separation chamber at a certain radial level and to an outlet conduit, and which is so arranged that a component separated during operation is discharged out of the separation chamber with a flow through this outlet and further out of the rotor through the outlet conduit when the separation chamber is filled up radially inwardly to a radial level located radially inside this inner outlet and a supply of liquid is taking place, a flow sensor being arranged in the outlet conduit to indicate this flow. The rotor also forms an intermittently openable radially outer outlet, which is connected to the separation chamber radially outside the first mentioned outlet at a radially outer portion of the separation chamber, in which during operation at least one separated component, which is specifically heavier than the first mentioned separated component, is accumulated, this second radially outer outlet being arranged to intermittently discharge during operation a predetermined volume of components out of the separation chamber in such a way that the radial level, up to which the separation chamber is filled, is displaced radially outwardly and the flow of the separated component in the outlet conduit ceases temporarily until the separation chamber has been refilled.

BACKGROUND OF THE INVENTION

During operation of a centrifugal separator of this kind components having different densities in the liquid mixture, which is supplied to the separation chamber via the inlet chamber, are separated, the specifically heaviest components being accumulated in the radially outermost portion of the separation chamber. Gradually the accumulated volume of the heaviest component is built up radially inwardly and reaches eventually a radial level, at which some of the heaviest component is entrained in the flow of a specifically lighter component radially inwardly in the separation chamber and further out of the separation chamber through the radially inner outlet and is thereby deteriorating the separation result. To be able to continue the centrifugal separation without deteriorating the separating result a predetermined volume of the content of the separation chamber is discharged intermittently out of the separation chamber through the radially outer outlet at equal time intervals or when deterioration of the separation result can be indicated.

The intermittent discharge is then controlled by an equipment, which has a monitoring unit comprising a device, which is arranged to initiate the intermittent discharge of the predetermined volume while the separated component is discharged out of the separation chamber and to finish the discharge and to start a filling of the separation chamber by supplying the liquid mixture of components, whereby the radial level up to which the rotor is filled, is displaced radially inwardly and a flow of the separated component after an intended discharge flows through the outlet conduit again. Often the monitoring unit also comprises a time measuring device, a memory, a comparing device, and an indicating device.

In the German patent publication DE 41 11 933 C1 a method is suggested in a centrifugal separator to monitor that a wanted partial volume of the contents of the separation chamber is discharged intermittently in a correct manner. According to this method a current consumption of the electrical motor, which drives the rotor of the centrifugal separator, immediately before an intermittent discharge and then the current consumption increased by the discharge is measured. The difference between the two measured values is compared with a value, which corresponds to an increase of the current consumption as a result of a correct intermittent discharge, and the deviation of the difference from this value is evaluated in a control unit.

However, the current consumption varies also for other reasons, which means that an increase of the current consumption not always is representative for a monitored discharge. Besides, the method demands an extra measuring equipment, which makes the monitoring expensive.

SUMMARY OF THE INVENTION

The object of the present invention is to accomplish a method and an equipment for monitoring a centrifugal separator of the kind initially described, which makes it possible to reliably and at a low expense monitor that the intermittent discharge of the predetermined volume is taking place in a correct manner.

According to the present invention this is achieved by the fact that a time measuring device measures the time from a chosen reference point of time, which can be related to the point of time for the start of the refilling of the separation chamber, to a point of time when the flow sensor indicates a flow in the outlet conduit again after the separation chamber has been refilled, that a memory stores the shortest allowable time for refilling of the separation chamber, that a comparing device compares one of the time measuring device measured time with the shortest allowable time stored in the memory, and that a indicating device is arranged to give a signal if the measured time is shorter than the shortest allowable time stored in the memory.

In a preferred embodiment of the invention the supply of the liquid mixture of components, which are to be centrifugally separated, is shut off before the predetermined volume intermittently is discharged and reopened when the discharge is finished.

In another embodiment of the invention the predetermined volume is the total volume of the components present in the separation chamber.

The above mentioned reference point of time is suitably the point of time for the start of the refilling.

The predetermined volume is preferably discharged out of the separation chamber through a radially outer outlet, which is connected to the separation chamber at its radially outermost periphery.

In a special embodiment of the invention also a longest allowable time for the refilling of the separation chamber is stored, the measured time then being compared with the longest allowable time, and that a signal is given if the measured time is longer than the longest allowable time stored in the memory. In the following the invention is described more closely with reference to the attached drawings.

BRIEF DESCRIPTION OF THE DRAWINGS

In these FIG. 1 schematically shows an axial section through a rotor in a centrifugal separator, which is provided with an equipment for monitoring the same according to the invention.

DETAILED DESCRIPTION

Figure 1:
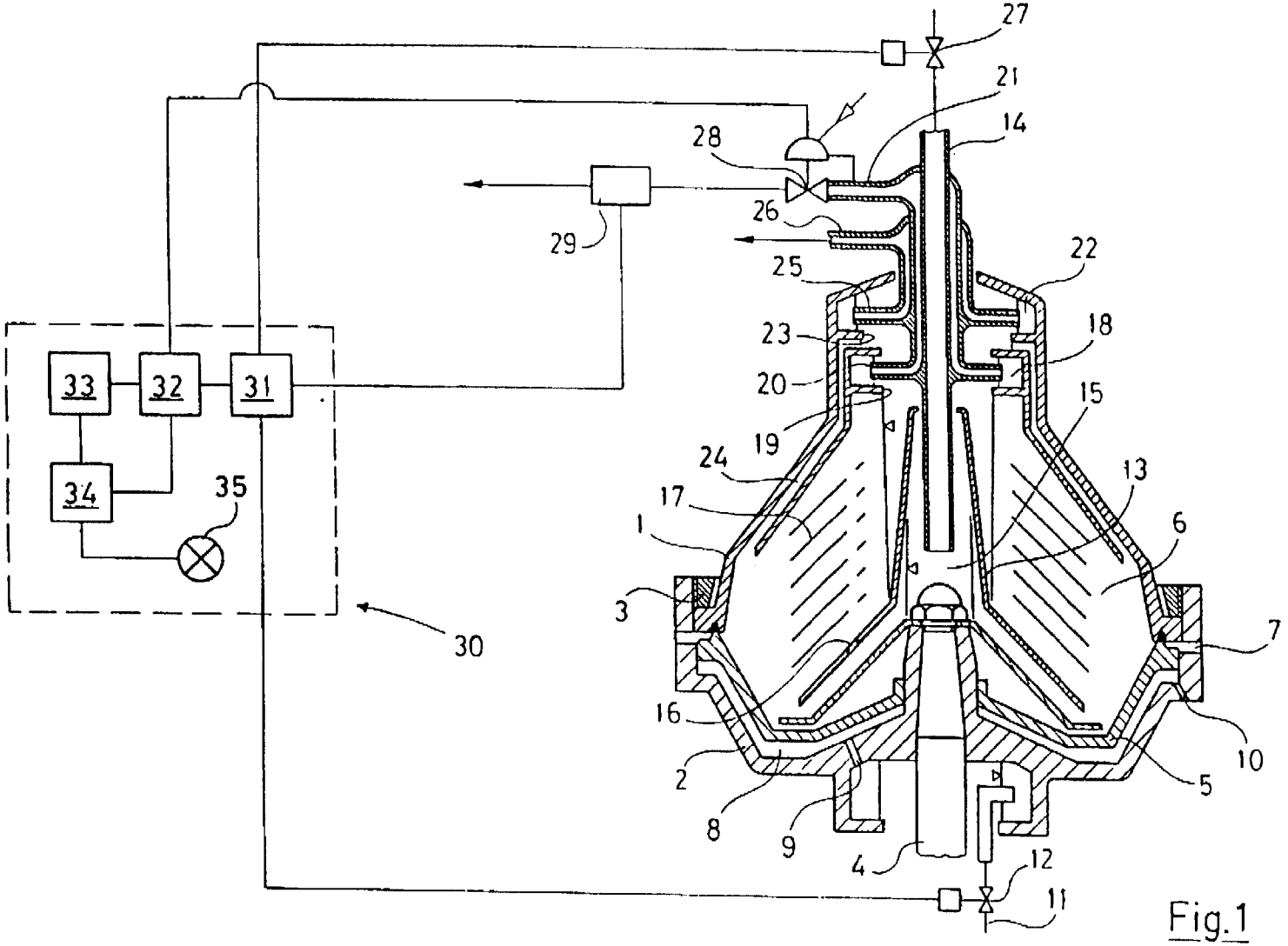

The rotor shown in FIG. 1 comprises an upper part 1 and a lower part 2, which are kept together by a locking ring 3. The rotor also is supported by a driving shaft 4, which is connected to the lower part 2.

Inside the rotor a valve slide 5 is arranged axially movable in the lower part 2. The valve slide 5 forms together with the upper part 1 a separation chamber 6 and is arranged to intermittently open and close an annular gap at the largest periphery of the separation chamber 6 between the separation chamber 6 and a radially outer outlet 7 for an intermittent discharge of a component, which during operation has been separated out of a liquid mixture supplied to the rotor, and which has been accumulated in a radially outer portion of the separation chamber 6. The valve slide 5 delimits together with the lower part 2 a closing chamber 8, which is provided with an inlet 9 and a throttled outlet 10 for a closing liquid. The closing liquid is supplied to the inlet via a conduit 11, which is provided with a magnetic valve 12.

Centrally in the rotor a distributor 13 is arranged, which surrounds a stationary inlet tube 14 and inside itself forms an inlet chamber 15, which communicates with the separation chamber 6 via relatively centrally located holes 16 in the conical lower part of the distributor 13. Inside the separation chamber 6 a stack of a number of frusto-conical separation discs 17 is arranged coaxially with the rotational axis.

As shown in FIG. 1, the upper part forms in its upper end a first central outer chamber 18 for discharge of a component separated during operation. This first outlet chamber 18 communicates with the separation chamber 6 via a first overflow outlet 19. In this outlet chamber 18 a first stationary discharge device 20 is arranged to discharge the separated component out of the rotor through a first outlet conduit 21. The first overflow outlet 19, the first outlet chamber 18, and the first stationary discharge device 20 form together a radially inner outlet for the separated component, which is connected to the separation chamber 6 via the first overflow outlet 19.

In the centrifugal separator shown as an example the upper part also forms a second central outlet chamber 22, which communicates with the separation chamber 6 via a second overflow outlet 23 and a channel 24, which opens in the separation chamber radially outside the first overflow outlet but radially inside the connection to the separation chamber 6 of the radially outer outlet 7. In this second outlet chamber 22 a second stationary discharge device 25 is arranged, which is connected to a second outlet conduit 26.

This second outlet chamber 22 and discharge device 25 out of the separation chamber 6 are not necessary for the invention but the embodiment shows that the invention also is applicable for centrifugal separating of three components, which are included in a liquid mixture supplied to the separation chamber 6, it being possible for the three separate components to be discharged through separate outlets.

The inlet tube 14 is provided with a magnetic valve 27, which makes it possible that the supply of the liquid mixture of components, which are to be separated, can be interrupted before an intermittent discharge is started and be re-opened when a discharge has been finished.

The first outlet conduit 21 is provided with a flow sensor 28. The flow sensor 28 may consist of a pressure sensor, which indicates the pressure drop over a flow restriction in the outlet conduit 21, but can alternatively for instance consist of a constant pressure valve. In that case the constant pressure valve has a position sensor, which indicates the position of a valve portion and thereby indirectly the flow in the outlet conduit 21 when the pressure drop over the valve is kept constant. As shown in FIG. 1, the first outlet conduit 21 is also provided with a sensor 29 which indicates the purity of the separated component flowing in the conduit. This sensor might for instance sense the capacitance or conductivity of the separated component flowing in the outlet conduit.

If the flow sensor 28 consists of a pressure sensor and the flow of the separated component is low it might be suitable to provide the outlet conduit 21 with a shut off valve, which is arranged downstream from the flow sensor 28 and is kept closed during the intermittent discharge and is opened as soon as the flow sensor 28 indicates a flow in the outlet conduit 21 again.

A monitoring unit 30 is connected to the centrifugal separator, which comprises a device 31, which is arranged to initiate the intermittent discharge, to finish the discharge, and to start a refilling of the separation chamber 6 by a supply of the liquid mixture of components, a time measuring device 32, which is arranged to measure the time $T_M$ from a chosen reference point of time, which can be related to the point of time when a refilling of the separation chamber 6 is started, to a point of time when the flow sensor 28 indicated a flow in the outlet conduit 21 again after the separation chamber has been refilled, a memory 33, which is arranged to store a shortest allowable time, which compared with a stored time $T_S$ for a refilling of the separation chamber 6 after a correctly performed discharge as a maximum is $\Delta T_{MAX}$ shorter, i.e. $T_S-\Delta T_{MAX}$, a comparing device 34, which is arranged to compare a time $T_M$ measured by the time measuring device 32 with the shortest allowable time $T_S-\Delta T_{MAX}$ stored in the memory 33, and an indicating device 35, which is arranged to give an alarm signal if the measured time $T_M$ is shorter than the shortest allowable time $T_S-\Delta T_{MAX}$ stored in the memory 33, which alarm signal indicates that an intended discharge has not been taking place.

Figure 2:
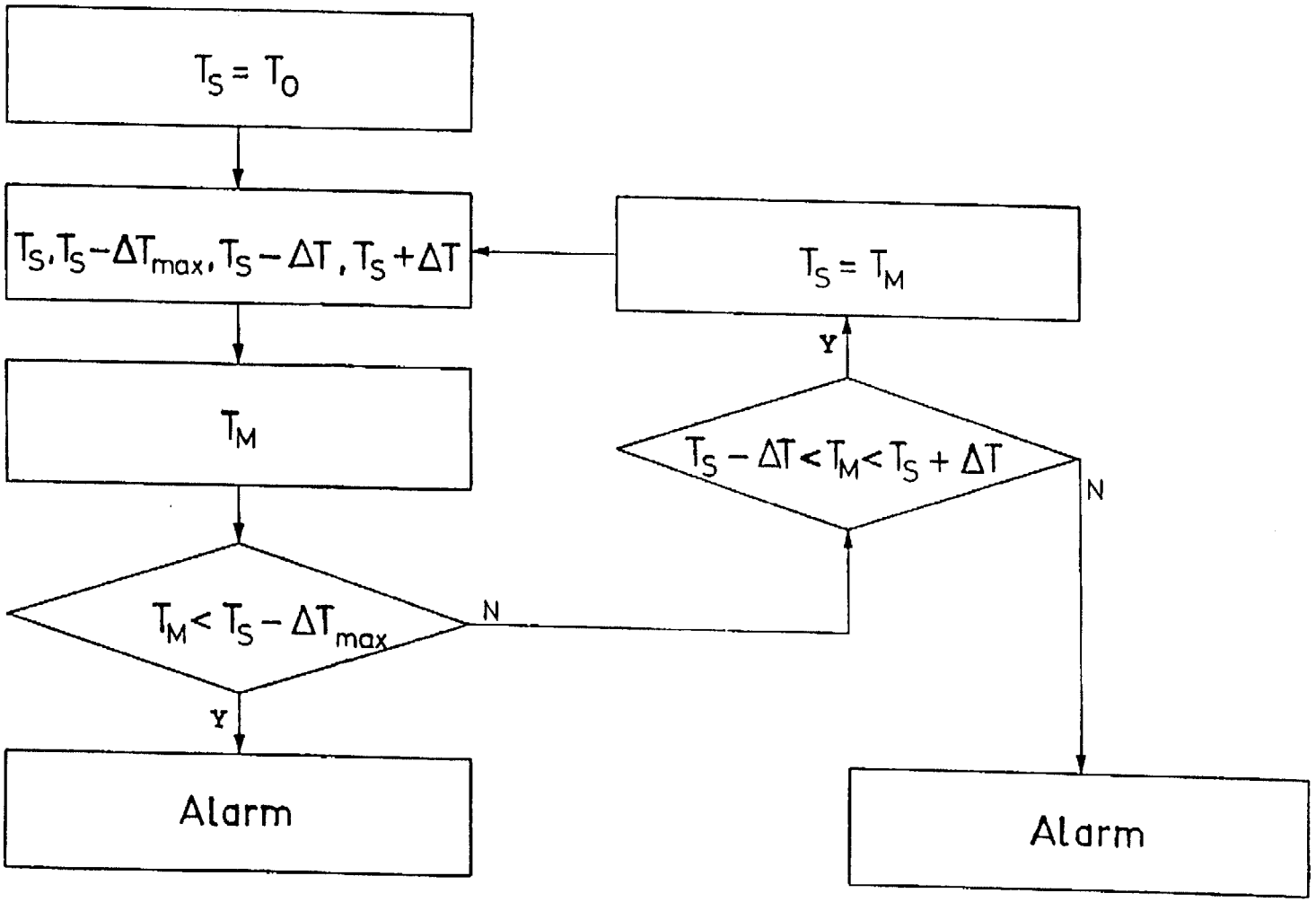
FIG. 2 shows a flow chart of a method according to the invention.
Figure 1:
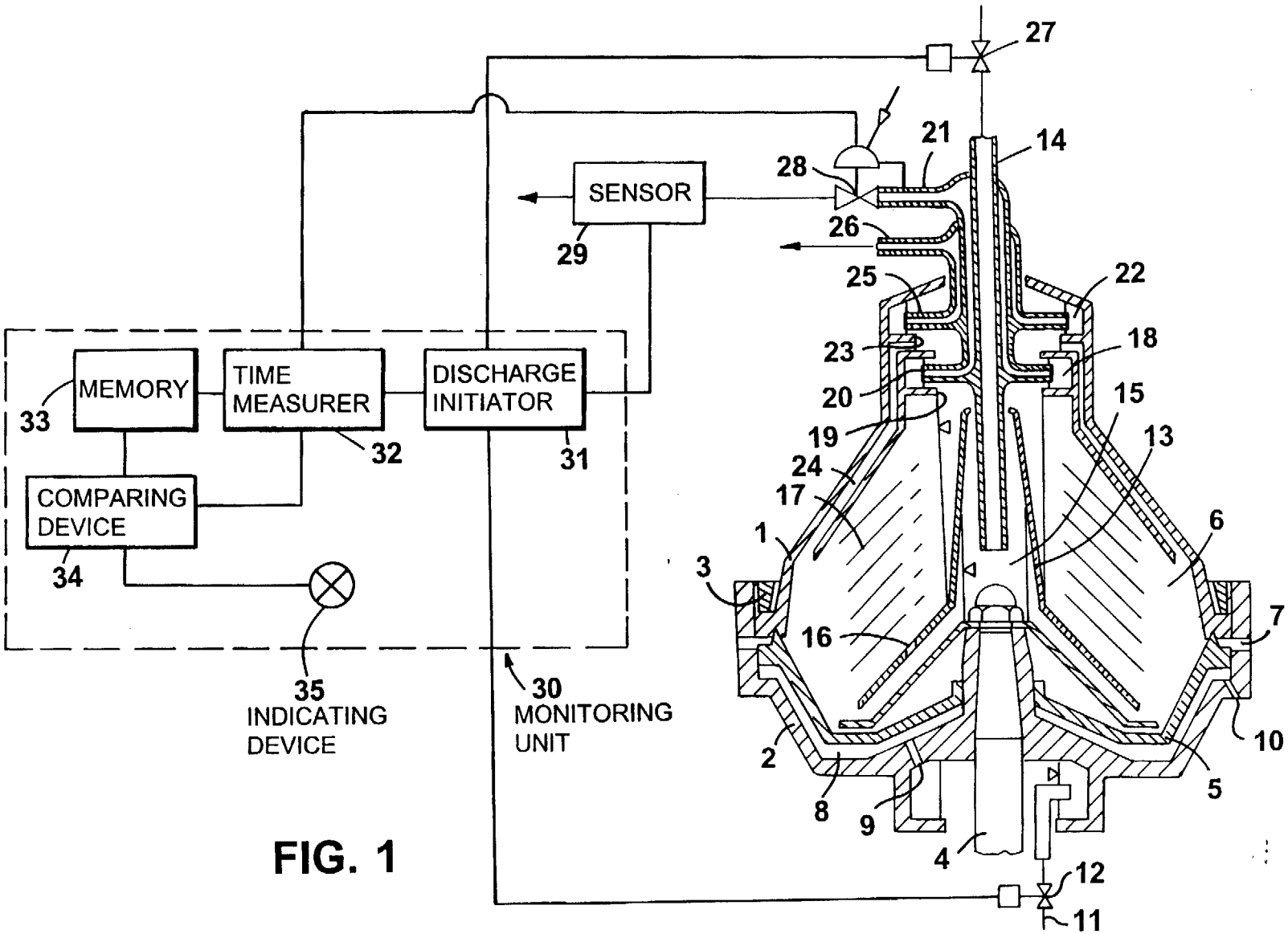
Figure 2:
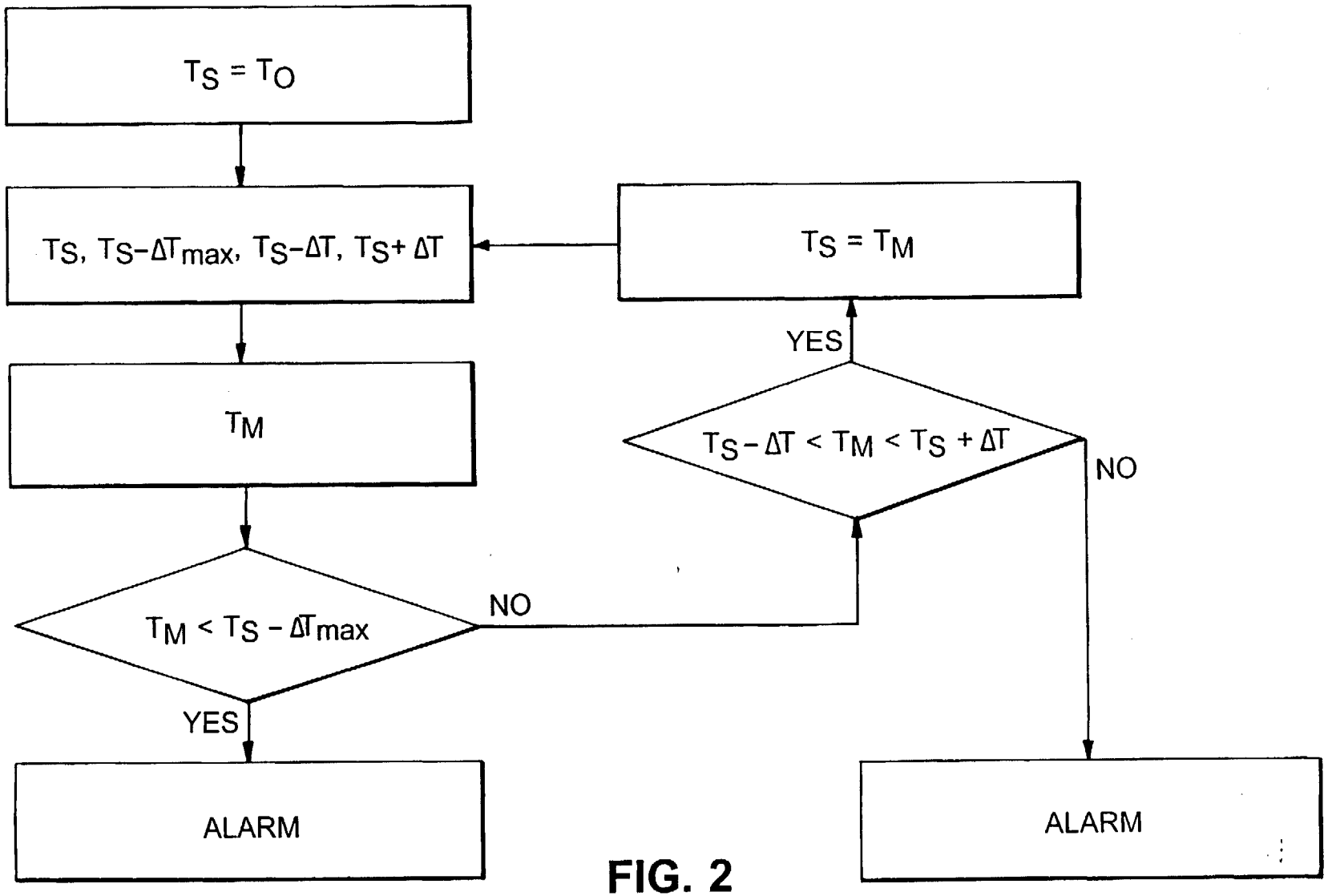

In a preferred embodiment of the method for monitoring a centrifugal separator according to the invention, which is illustrated by the flow chart shown in FIG. 2, a minimum value $T_S-\Delta T$ and a maximum value $T_S+\Delta T$ for refilling of the separation chamber 6 after an intended and correctly performed discharge is also stored. $\Delta T$ is shorter than $\Delta T_{MAX}$. If the measured time $T_M$ is not within the interval formed by these values an indicating device gives an alarm signal whereas the time $T_S$ for the refilling of the separation chamber 6 after a correctly performed discharge during a time period upon start of the centrifugal separation is set equal to the measured time $T_M$ if this is within the interval or equal to the average value of a number of measured times within this interval.

In a modified version of this embodiment it is also possible to store in the memory 33 also a predetermined number of consecutive latest measured times $T_M$ and in the comparing device 34 compare these, the indicating device 35 being arranged to give a signal if the measured times show a steady, gradual change in any direction. Thus it is possible to detect changes early in the centrifugal separation and make necessary measurements when needed.

A centrifugal separator, which is designed in accordance to the invention, works in the following manner:

Upon start of the centrifugal separator the rotor is brought into rotation and the separation chamber 6 is closed by opening the magnetic valve 12 so that closing liquid is supplied to the closing chamber 8 through the conduit 11 via the inlet 9. Thereafter the liquid mixture of components, which are to be centrifugally separated, can be supplied to the separation chamber 6 via the inlet tube 14, the inlet chamber 15 and the supply holes 16 in the distributor 13 and be distributed out into the interspaces between the separation discs 17 where the main separation is taking place. During separation the specific heavier components (component) flows radially outwardly and is accumulated in the radially outer portion of the separation chamber 6, while the specific lighter component flows radially inwardly and is accumulated in a centrally annular layer in the separation chamber.

The separated specifically lighter component flows out of the separation chamber 6 via the overflow outlet 19 into the first outlet chamber 18. The separated component is discharged out of this outlet chamber 18 through a first stationary discharge device 20 and further out of the rotor through a first outlet conduit 21 with a flow, which is indicated by the flow sensor 28. Instead of indicating the flow it can alternatively be measured by means of a flow measuring device. The volume increases gradually of the specifically heavier components accumulated in the radially outer portion of the separation chamber 6 and eventually it extends radially inwardly to a radial level nearby the radially outer edges of the separation discs 17, at which some of the heaviest components (component) are entrained in the flow of the specifically lighter component radially inwardly in the separation chamber 6 and further out of the separation chamber 6 via the overflow outlet and deteriorate the separation results. When a deteriorated separation result is indicated by the sensor 29 the device 31 initiates an intermittent discharge of a predetermined volume of the content of the separation chamber 6 of components out of the discharge openings 7.

Before the discharge is started the magnetic valve 27 is closed and the supply of liquid mixture, which is to be centrifugally treated is interrupted. Then the magnetic valve 12 is closed for a short period of time and the supply of closing liquid to the closing chamber via the inlet 9 is interrupted during this period of time. This means that the closing chamber 8 is emptied of closing liquid through the outlet 10 and the valve slide 5 moves downwards and an annular gap is opened, through which the predetermined volume of components flows out towards the outlet openings 7. The flow of the separated component through the outlet conduit 21 then ceases. When the device 31 re-opens the magnetic valve 12 the closing chamber is filled up and the annular gap is closed. If the magnetic valve 27 has been closed, the device 31 opens it again and the separation chamber is refilled. At the same time as the magnetic valve 27 is opened again or when the annular gap is closed the time measuring device 32 is set to zero. This point of time is the reference point of time. As soon as the separation chamber has been filled and the flow sensor indicates a flow of the separated component in the outlet conduit 21 again, the time $T_M$ is measured from the reference point of time. The measured time $T_M$ is compared with a shortest allowable time stored in the memory 33, which is $\Delta T_M$ shorter than a time $T_S$ for refilling of the separation chamber 6 after a correctly performed discharge stored in the memory 33, i.e. $T_S-\Delta T_{MAX}$. If the measured time $T_M$ is shorter than the shortest allowable time $T_S-\Delta T_{MAX}$ stored in the memory 33 an indicating device 35 gives an alarm signal, which indicates that an intended discharge has not been taking place.

In a preferred embodiment of the invention the measured time also is compared with a minimum value $T_S-\Delta T$ stored in the memory 33 and a maximum value $T_S+\Delta T$ also stored in the memory 33 for measured time $T_M$ for the refilling of the separation chamber 6 after an intended and correctly performed discharge. $\Delta T$ is then shorter than $\Delta T_{MAX}$. If the measured time $T_M$ is not within the interval limited by these values an indicating device gives an alarm signal. If the measured time $T_M$ is within this interval the stored time $T_S$ for the refilling of the separation chamber 6 after a correctly performed discharge during a period of time upon start of the centrifugal separation stored in the memory is set equal to the measured time $T_M$ or equal to the average value of a number of measured times within this interval. Before there is any measured time within the interval the time $T_S$ for the refilling of the separation chamber after a correctly performed discharge stored in the memory is set to an estimated and adjustable value $T_O$. If the measured time $T_M$ exceeds the maximum value $T_S+\Delta T$ stored in the memory, a signal is given, which indicates that there might be a leakage. If the measured time $T_M$ for the refilling after a performed discharge is shorter than the minimum valve $T_S-\Delta T$ for a correctly performed discharge stored in the memory 33 the indicating device 35 gives a signal, which indicates that the separation chamber has not been emptied totally but a portion of its contents, for instance sludge, did not follow out during the discharge, which might cause great rotor-dynamical problems.

Within the range of the invention the method and the equipment for monitoring a centrifugal separator can be used when centrifugal separating two or more components in the supplied liquid mixture. If the supplied liquid mixture contains three components they can be discharged through one separate outlet each as shown in FIG. 1. Within the range of the present invention the flow sensor 28 can be arranged in anyone of the two outlet conduits 21 and 26 as the flow in both ceases during the discharge and reoccurs as soon as the separation chamber 6 has been refilled.

What is claimed is:

1. A method for monitoring a centrifugal separator for separating a supplied mixture of liquid components, which has a rotor, which forms an inlet chamber (15), a separation chamber (6) connected to the inlet chamber (15), a radially inner outlet (18, 19, 20), which is connected to said separation chamber (6) at a certain radial level and to an outlet conduit (21), said radially inner outlet being so arranged that a first component separated during operation is discharged out of the separation chamber (6) with a flow through said outlet (18, 19 20) and further out of the rotor through the outlet conduit (21) when the separation chamber (6) is filled up radially inwardly to a radial level located radially inside said inner outlet (18, 19, 20) and liquid is being supplied, a flow sensor (28) being arranged in the outlet conduit (21) to indicate said flow, an intermittently openable radially outer outlet (7), which is connected to the separation chamber (6) radially outside the radially inner outlet (18, 19, 20) at a radially outer portion of the separation chamber (6), in which during operation at least one separated component, which is specifically heavier than the first separated component, is accumulated, this second radially outer outlet (7) being arranged to intermittently discharge during operation a predetermined volume of component out of the separation chamber (6) in such a way that the radial level, up to which the separation chamber (6) is filled is displaced radially outwardly and the flow of the first separated component in the outlet conduit (21) ceases temporarily until the separation chamber (6) has been refilled wherein a mixture of liquid components is supplied to the separation chamber (6), a first time is measured from a chosen reference point of time, related to the point of time at which the separation chamber (6) begins refilling, to a point of time next thereafter when the flow is indicated in the outlet conduit (21), a time ($T_O$, $T_S$) for refilling the separation chamber (6) following a correctly performed discharge of the predetermined volume is stored in a memory (33), a shortest allowable time ($T_S-\Delta T_{MAX}$) for refilling the separation chamber (6) is stored, the measured first time ($T_M$) is compared with the stored shortest allowable time ($T_S-\Delta T_{MAX}$) for refilling the separation chamber (6), and a signal is given if the first measured time ($T_M$) is shorter than the shortest allowable time ($T_S-\Delta T_{MAX}$) stored in the memory (33).

2. The method according to claim 1, wherein the supply of the mixture of liquid components, which are to be centrifugally separated, is shut off before the predetermined volume is discharged intermittently and the supply is begun again when the discharge of the predetermined volume is finished.

3. The method according to claim 1, wherein the predetermined volume is the total volume of the components present in the separation chamber (6).

4. The method according to claim 1, wherein the reference point of time is the point of time of the start of the refilling.

5. The method according to claim 1, wherein the outer outlet (7) is connected to the separation chamber (6) at its radially outermost periphery.

6. The method according to claim 1, further wherein a maximum value ($T_S+\Delta T$) for measured time ($T_M$) for refilling of the separation chamber (6) is stored in the memory (33), the measured time ($T_M$) is compared by a comparing device (34) with the maximum value ($T_S+\Delta T$), and a signal is given by an indicating device (35) if the measured time ($T_M$) is longer than the maximum value ($T_S+\Delta T$).

7. The method according to claim 6, further wherein a minimum value ($T_S-\Delta T$) is stored in the memory (33), the measured time ($T_M$) is compared with the minimum value ($T_S-\Delta T$), a signal also is given if the measured time ($T_M$) is shorter than the minimum value ($T_S-\Delta T$), and the time ($T_S$) stored in the memory (33) for refilling the separation chamber (6) following a correctly performed discharge of the predetermined volume upon start-up of the centrifugal separator is set equal to the average of at least one previously measured time within an interval, which interval is formed by the minimum value ($T_S-\Delta T$) and the maximum value ($T_S-\Delta T$).

8. The method according to claim 7, wherein the memory (33) is arranged to store a predetermined number of consecutive latest measured times ($T_M$) and the comparing device (34) is arranged to compare said latest measured times and the indicating device (35) is arranged to give a signal when they show a steady gradual change in any direction.

9. Equipment for monitoring a centrifugal separator for separating a supplied mixture of liquid components, which has a rotor, which forms an inlet chamber (15), a separation chamber (6) connected to the inlet chamber (15), a radially inner outlet (18, 19, 20), which is connected to the separation chamber (6) at a certain radial level and to an outlet conduit (21), said radially inner outlet being so arranged that a first component separated during operation is discharged out of the separation chamber (6) with a flow through said outlet and further out of the rotor through the outlet conduit (21) when the separation chamber (6) is filled up radially inwardly to a radial level located radially inside said inner outlet and liquid is being supplied, a flow sensor (28) arranged in the outlet conduit (21) to indicate this flow, an intermittently openable radially outer outlet (7), which is connected to the separation chamber (6) radially outside the radially inner outlet at a radially outer portion of the separation chamber (6), in which at least one component separated during operation, which is specifically heavier than the first mentioned separated component, is accumulated, the radially outer outlet (7) being arranged to intermittently discharge during operation a predetermined volume of component out of the separation chamber (6) in such a way that the radial level, up to which the separation chamber (6) is filled, is displaced radially outwardly and the flow of the separated component in the outlet conduit (21) ceases temporarily until the separation chamber (6) is refilled, the equipment having a monitoring unit (30) comprising a discharge device (31), which is arranged to initiate the intermittent discharge of the predetermined volume while the separated component is discharged out of the separation chamber (6) and to finish the discharge and to start a refilling of the separation chamber (6) with the supplied mixture of liquid components, whereby the radial level, up to which the separation chamber (6) is filled, is displaced radially inwardly and a flow of the separated component passes through the outlet conduit (21) again after an intended discharge, a time measuring device (32), operatively connected to the flow sensor (28) via the discharge device (31), a memory (33) operatively connected to the time measuring device (32), a comparing unit (34) to compare information stored in the memory (33) and information from the time measuring device (32), and an indicating device (35) operatively connected to the comparing unit (34), wherein the time measuring device (32) is arranged to measure the time from a chosen reference point of time, related to the point of time at which the separation chamber (6) begins refilling to a point of time when the flow sensor (28) next indicates a flow again in the outlet conduit (21) after the separation chamber (6) has been refilled, the memory (33) is arranged to store a time ($T_O$,$T_S$) for refilling the separation chamber (6) after a correctly performed discharge of the predetermined volume and to store a shortest allowable time ($T_S-\Delta T_{MAX}$) for refilling the separation chamber (6), the comparing unit (34) is arranged to compare a time ($T_M$) measured by the time measuring device (32) with the shortest allowable time stored in the memory (33), and the indicating device (35) is arranged to give a signal if the measured time ($T_M$) is shorter than the shortest allowable time ($T_S-\Delta T_{MAX}$) stored in the memory (33).

10. The equipment according to claim 9, wherein the memory (33) also stores a longest allowable time ($T_S-\Delta T$) for the refill of the separation chamber (6), and the comparing unit (34) is also arranged to compare a time ($T_M$) measured by the time measuring device (32) with the longest allowable time ($T_S-\Delta T$), and the indicating device (35) is arranged to give a signal if the measured time ($T_M$) is longer than the longest allowable time ($T_S-\Delta T$) stored in the memory (33).

* * * * *

UNITED STATES PATENT AND TRADEMARK OFFICE

CERTIFICATE OF CORRECTION

PATENT NO. : 5,800,330
DATED : Sep. 1, 1998
INVENTOR(S) : Modéer

It is certified that error appears in the above-identified patent and that said Letters Patent is hereby corrected as shown below:

The title page should be deleted to appear as per attached title page.

Please delete drawing sheets 1 and 2 and substitute drawing sheets 1 and 2 as per attached.

Signed and Sealed this

Second Day of March, 1999

*Attest:*

*Attesting Officer*

Q. TODD DICKINSON

*Acting Commissioner of Patents and Trademarks*

United States Patent [19]

Modéer

[11] Patent Number: 5,800,330

[45] Date of Patent: Sep. 1, 1998

[54] METHOD AND EQUIPMENT FOR MONITORING A CENTRIFUGAL SEPARATOR

[75] Inventor: Bo Modéer, Tumba, Sweden

[73] Assignee: Alfa Laval AB, Lund, Sweden

[21] Appl. No.: 776,200

[22] PCT Filed: Jul. 20, 1995

[86] PCT No.: PCT/SE95/00877

§ 371 Date: Apr. 18, 1997

§ 102(e) Date: Apr. 18, 1997

[87] PCT Pub. No.: WO96/03214

PCT Pub. Date: Feb. 8, 1996

[30] Foreign Application Priority Data

Jul. 22, 1994 [SE] Sweden ..... 9402563

[51] Int. Cl.[6] ..... B04B 1/14; B04B 11/04

[52] U.S. Cl. ..... 494/2; 494/5; 494/10; 494/11; 494/37

[58] Field of Search ..... 494/1–5, 10, 11, 494/23, 27, 30, 37, 56, 68, 70, 85

[56] References Cited

U.S. PATENT DOCUMENTS

| | | | |
|---|---|---|---|
| 3,160,589 | 12/1964 | Stone . | |
| 3,167,509 | 1/1965 | Steinacker | 494/3 |
| 3,593,915 | 7/1971 | Steinacker | 494/3 |
| 3,976,242 | 8/1976 | Hemfort | 494/3 |
| 4,305,817 | 12/1981 | Kohlstette | 494/3 X |
| 4,411,645 | 10/1983 | Tenthoff | 494/3 |
| 4,820,256 | 4/1989 | Nordstrom | 494/5 X |
| 4,840,612 | 6/1989 | Pallmar | 494/2 |

FOREIGN PATENT DOCUMENTS

| | | |
|---|---|---|
| 3841634 | 8/1989 | Germany . |
| 345603 | 6/1972 | Sweden . |
| 375021 | 4/1975 | Sweden . |
| 413464 | 6/1980 | Sweden . |
| 422416 | 3/1982 | Sweden . |
| 8804601 | 6/1989 | Sweden . |

*Primary Examiner*—Charles E. Cooley
*Attorney, Agent, or Firm*—Fish & Richardson P.C.

[57] ABSTRACT

Method and equipment for monitoring a centrifugal separator, with a separation chamber (6), a radially inner outlet (18, 19, 20) connected to the separation chamber (6), which is connected to an outlet conduit (21), a flow sensor (28) in the outlet conduit (21) being arranged to indicate a flow in the outlet conduit, an intermittently operable radially outer outlet (7) connected to the separation chamber (6), the flow of the separated component in the outlet conduit (21) ceasing temporarily until the separation chamber (6) has been refilled. In order to monitor the centrifugal separator in a reliable and easy manner the time for the refilling of the separation chamber (6) is measured and is compared with a shortest allowable time for the refilling of the separation chamber (6) stored and a signal is given if the measured time is shorter than the shortest allowable time stored in the memory.

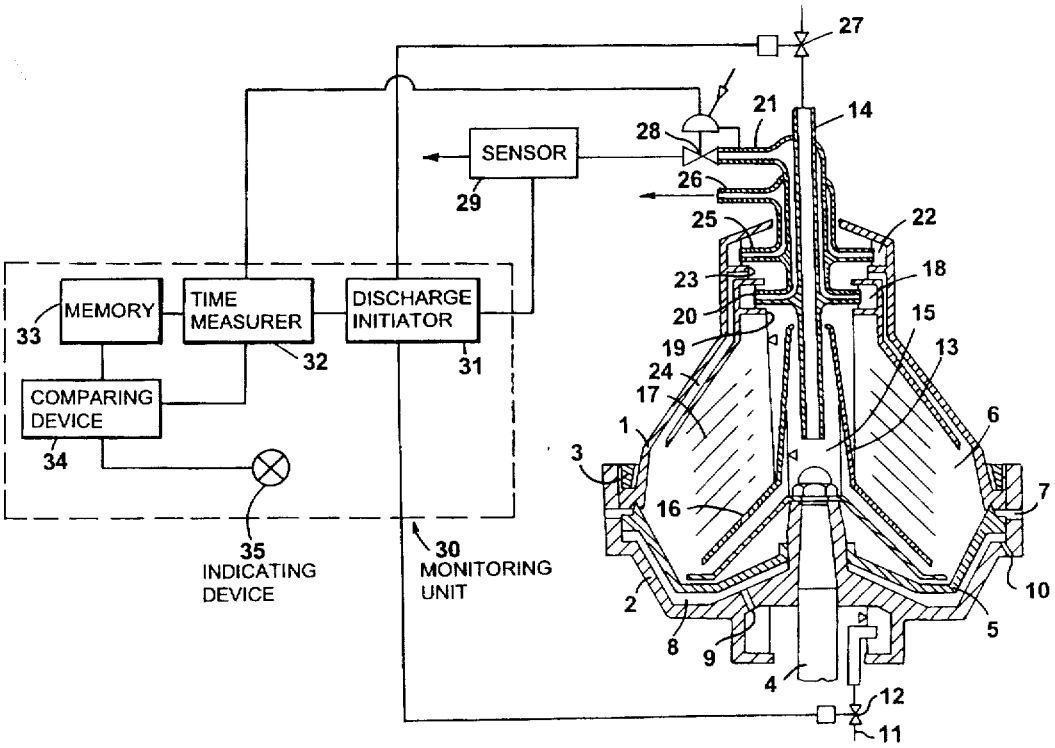

10 Claims, 2 Drawing Sheets